252-103 AU 166 EX
9/1/81 XR 4,287,079

United States Patent [19]
Robinson

[11] 4,287,079
[45] Sep. 1, 1981

[54] LIQUID CLEANSER FORMULA

[75] Inventor: Ronald A. Robinson, Garden Grove, Calif.

[73] Assignee: Purex Corporation, Lakewood, Calif.

[21] Appl. No.: 155,571

[22] Filed: Jun. 2, 1980

[51] Int. Cl.[3] ..... C11D 7/54
[52] U.S. Cl. ..... 252/99; 252/95; 252/103; 252/174.25
[58] Field of Search ..... 252/95, 99, 103, 174.25

[56] References Cited

U.S. PATENT DOCUMENTS

| | | | |
|---|---|---|---|
| 3,985,668 | 10/1976 | Hartman | 252/99 |
| 4,005,027 | 1/1977 | Hartman | 252/99 X |
| 4,051,055 | 9/1977 | Trinh et al. | 252/99 X |
| 4,051,056 | 9/1977 | Hartman | 252/95 X |
| 4,116,849 | 9/1978 | Leikhim | 252/95 |
| 4,116,851 | 9/1978 | Rupe et al. | 252/95 X |
| 4,129,527 | 12/1978 | Clark et al. | 252/174.25 |

*Primary Examiner*—Mayer Weinblatt
*Attorney, Agent, or Firm*—William W. Haefliger

[57] ABSTRACT

An aqueous cleaning composition to be applied from a squirt bottle comprises a particulate abrasive, a two-part thickness consisting essentially of a mixture of fumed silicon dioxide and smectite clay, a hypo-halite bleach, alkaline builder salt, and water.

9 Claims, No Drawings

LIQUID CLEANSER FORMULA

BACKGROUND OF THE INVENTION

This invention relates generally to liquid cleansers, and specifically to such cleansers characterized by very low syneresis, and capability to cling to surfaces to be cleaned after being discharged as a spray, as for example from a squirt bottle.

Thickened cleansers involving hypochlorite compositions, are known. See for example U.S. Pat. No. 4,116,851, and patents referenced therein. It is believed that none of such patents teach or suggest applicant's particular composition involving a two-part thickening system, and having the desirable characteristics, as referred to.

SUMMARY OF THE INVENTION

Basically, the improved composition comprises:

(a) particulate abrasive,
(b) a two-part thickener consisting essentially of a mixture of fumed silicon dioxide and smectite clay,
(c) a hypo-halite bleach,
(d) alkaline builder salt, and
(e) water in an amount which is in excess of 50% by weight of the composition.

As will appear, the two-part thickener provides desirable plastic rheology characteristics, including thixotropic quality enabling discharge as a spray followed by clinging to a surface to be cleaned (for example without undesirable drainage).

Other components of the system include a surfactant, perfume, colorant and water.

DETAILED DESCRIPTION

The abrasive component of the system is a diatomaceous earth, as for example Dicalite SP5 produced by the Dicalite Division of Grefco, Inc. It is characterized as having low specific gravity (0.2 to 3.0) and small particle size (150 microns or less). Other usable abrasives include insoluble carbonates such as calcium carbonate, and phosphates such as $Ca_3(PO_4)_2$ and $Ca(PO_3)_2$; complex silicates such as zeolite feldspar, and zirconium and calcium silicates; metal oxides such as titanium dioxide, $ZnO_2$, CaO and $Al_2O_3$; and silica.

The bleach component is preferably sodium hypochlorite, which yields hypochlorite on contact with water. Other useful hypochlorites include potassium hypochlorite, calcium hypochlorite, magnesium hypochlorite, calcium hypochlorite and lithium hypochlorite, i.e. the alkaline earth metal hypochlorites. Other useful hypo-halites include, for example, hypobromite.

An important component of the formula is the two-part thickening system, whose function is to impart to the aqueous mixture plastic rheology characteristics. The latter include a thixotropic quality enabling discharge in fluid state from a squirt bottle, as against a wall surface, followed by clinging of the mix to the wall. Thus, the viscosity of the following mixture should not be so great as to prevent discharge from a hand operated squirt bottle having an orifice of between 1/16 and ⅛ inches diameter. Such two-part thickening system preferaby includes a mixture of fumed silicon dioxide and a natural or synthetic smectite clay of the montmorillonite (Bentonite) type, the weight percent of clay normally exceeding the weight percent of fumed silica. An example of usable fumed silicon dioxide is CAB-O-SIL M5, a product of Cabot Corporation; and an example of a usable natural clay is VOLCLAY SPV 200, a product of American Colloid Co. These thickeners co-act, synergistically, to provide the desired physical properties of the mixture, including the prevention of layering of the mix in the bottle inhibiting reconstituting of the mix in a dischargeable spray form (from the squirt bottle).

A further component of the mix is a builder salt, which also contributes to maintenance of particles in suspension, and minimizes syneresis. A preferred builder is potassium carbonate but other usable compounds include $Na_2CO_3$, NaOH and KOH; pyrophosphates including $Na_4P_2O_7$, and $K_4P_2O_7$; polyphosphates including $Na_5P_3O_{10}$, and $K_5P_3O_{10}$; orthophosphates such as $Na_3PO_4$, and $K_3PO_4$; and polysilicates such as $Na_2SiO_3$, and $Na_2O: 2SiO_2$. An additional function of the builder is to adjust the pH of the aqueous mix to between 10 to 12, on a 1% solution basis, i.e. in the alkaline range wherein the bleach component is stable.

Other salts can be added as viscosity modifiers. These include, but are not limited to, NaCl and KCl. Depending on the thickening system need, they will increase or decrease the yield value. They will also increase or decrease the apparent viscosity. An additional effect of their addition is to increase the specific gravity of the liquid phase as well as that of the complete formula. It should be pointed out that adding 5¼% liquid laundry bleach also means that an approximate equal molar amount of NaCl is added because the laundry bleach contains NaCl as a by product of the chlorination reaction.

A bleach stabilizing surfactant component in the formula is an alkyl sulfate salt, preferably sodium lauryl sulfate. Other usable salts of the category include potassium lauryl alkyl sulfate, sodium stearyl alkyl sulfate, and potassium stearyl alkyl sulfate.

Optional components include a perfume such as isobornylacetate, and a coloring agent such as Graphtol Green 5869-2. The balance of the system consists of water.

EXAMPLE 1

| | % wt |
|---|---|
| Dicalite SP5 | 5.0 |
| Cab-O-Sil M5 | 1.0 |
| Valclay SPV-200 | 4.0 |
| $N_aOCl$, 5¼% bleach as is | 18.0 |
| $K_2CO_3$ | 2.0 |
| Isobornylacetate | 0.1 |
| Sodium lauryl sulfate | 0.3 |
| Graphtol Green 5869-2 | 0.01 |
| Water | q.s. |

This product has excellent phase stability and shows little or no syneresis after one year of storage at 70° F. Its flow measured on a Consistometer (Central Scientific Co. #24925) at 70° F. is between 8 and 14 cm.

EXAMPLE 2

Like Example 1 except potassium carbonate at 8%. This gives a much more alkaline formula, and yet the physical characteristics are very similar.

EXAMPLE 3

| | % wt |
|---|---|
| Same as Example 1, except | |
| CAB-O-SIL M5 | 3.0 |
| VOLCLAY SPV 200 | 0 |

In this formula the initial viscosity characteristics are similar to Example 1. However, the formula develops severe syneresis. If the Cal-O-Sil M5 is increased to 4% the syneresis is reduced but it is still greater than Example 1. In addition, at 4% Cal-O-Sil M5, the flow is very poor due to the very high viscosity. A reading of about 3 cm is obtained initially. At this level the product is extremely difficult to use in a squirt bottle.

EXAMPLE 4

Like Example 1 except 0.5% potassium hydroxide added. This formula has better chlorine stability than Example 1. A typical loss with an Example 1 type formula is 13% available $Cl_2$ in 3 months at 70° F. This product with the 0.5% KOH shows only a 6% loss in available $Cl_2$.

EXAMPLE 5

Same as Example 4 except Dicalite SP-5 replaced with Kenite 300 (supplied by Witco Chemical). The physical characteristics of the finished products are identical.

EXAMPLE 6

Same as Example 1 except Volclay reduced to 3.5% and Dicalite SP-5 replaced with Bulk-Aid 30 (Grefco Inc.). The Bulk-Aid 30 is a perlite product having specific gravity of 2.34 and smaller particle size distribution then Dicalite SP-5. Bulk-Aid 30 has about 93% of the particles 10 microns or less while Dicalite SP-5 has only about 43% 10 microns or less. The resistance to syneresis of this formula is very good.

| | % wt |
|---|---|
| Cab-O-Sil M5 | 1.75 |
| Wyobond 200 clay | 2.0 |
| Tripotassium phosphate | 2.0 |
| Tetrapotassium pyrophosphate | 6.0 |
| 5¼% liquid laundry bleach (NaOCl) | 16.2 |
| Sodium lauryl sulfate | 0.25 |
| Q Cell 200 | 5.0 |
| Graphtol Green 5869-2 | 0.01 |
| Isobornylacetate | 0.1 |
| Water | q.s. |

In this formulation the phosphates replace the carbonate as the builder and Q Cell 200 (Philadelphia Quartz) replaces the Dicalite SP-5.

Q Cell 200 is a specially process silica having a specific gravity of about 0.2 and an average particle size of about 45 microns. The formula has the same general flow characteristics as Example 1. Its resistance to syneresis is good.

EXAMPLE 8

| | % wt |
|---|---|
| Cab-O-Sil M5 | 1.0 |
| Volclay SPV 200 | 3.0 |

-continued

| | % wt |
|---|---|
| Q Cell 200 | 5.0 |
| Sodium Lauryl sulfate | 0.30 |
| Potassium Carbonate | 8.0 |
| 5¼% liquid laundry bleach (NAOCl) | 18.0 |
| Graphtol Green 5869-2 | 0.01 |
| Isobornylacetate | 0.1 |
| Water | q.s. |

This is a no phosphate version of Example 7. Both Examples 7 and 8 have similar stability of the suspension of Q Cell 200.

EXAMPLE 9

| | % wt |
|---|---|
| same as Example 1, except | |
| Cab-O-Sil M5 | 0 |
| Volclay SPV 200 | 6.0 |

In this formula the initial viscosity characteristics are very much like Example 1. However, this formula develops severe syneresis at 70° F. after a few weeks of storage.

Weight percent ranges of components, and preferred weight percents (for best results) are as follows:

| Component | Range (wt. %) | Preferred (wt. %) |
|---|---|---|
| abrasive (Dicalite SP5) | 0–20% | 5% |
| fumed silicon dioxide (Cab-O-Sil M5) | 0–5% | 1% |
| Smectite clay (VOLCLAY SPV 200) | 0–15% | 4% |
| NaOCL, 5¼% bleach | 0–40% | 18.0% |
| $K_2CO_3$ (builder salt) or $NaCO_3$ | 0–15% | 2.0% |
| KCL | 0–15% | 0.0% |
| surfactant (sodium lauryl sulfate) | 0–5% | 0.3% |
| Isobornylacetate | 0–1% | 0.1% |
| Colorant (Graphtol Green 5862-2) | 0–0.1% | 0.01% |
| Water | balance | balance |

As is clear, the water exceeds 50%, by weight, of the composition.

I claim:

1. An aqueous cleaning composition to be applied from a squirt bottle comprising (a) about 5 up to 20 weight percent of particulate abrasive selected from the group consisting of diatomaceous earth, calcium carbonate, $Ca_3(PO_4)_2$, $Ca(PO_3)_2$, zeolite feldspar, zirconium silicate, calcium silicate, titanium oxide, $ZnO_2$, CaO, $Al_2C_3$ and silica;

(b) a two part thickener consisting essentially of a mixture of fumed silicon dioxide and smectite clay, the fumed silicon dioxide being present in weight percent amount between about 1 and 5, the clay being present in weight percent amount between about 4 and 15;

(c) about 18 up to 40 weight percent weak aqueous hypo-halite bleach solution, the hypo-halite selected from the group consisting of sodium hypochlorite, potassium hypochlorite, calcium hypochlorite, magnesium hypochlorite, lithium hypochlorite and hypobromite;

(d) about 2 up to 15 weight percent alkaline builder salt selected from the group consisting of potassium carbonate, $Na_2CO_3$, NaOH, KOH, $Na_4P_2O_7$, $K_4P_2O_7$, $Na_5P_3O_{10}$, $K_4P_3O_{10}$, $Na_3PO_4$, $K_3PO_4$, $NaSiO_3$, $Na_2O$: $2SiO_2$, and (e) water in an amount which is in excess of 50% by weight of the composition.

2. The cleansing composition of claim 1 wherein said fumed silicon dioxide is present in an amount which is about 1% by weight of the composition, and said clay is present in an amount which is about 4% by weight of the composition.

3. The cleansing composition of claim 1 wherein said alkaline builder salt is present in an amount which is about 2% by weight of the composition.

4. The cleansing composition of claim 1 wherein said builder salt consists of potassium carbonate and is present in amount sufficient to keep undissolved particles in suspension and to minimize syneresis.

5. The cleansing composition of claim 1 wherein said bleach consists of a weak aqueous solution of sodium hypochlorite.

6. The cleansing composition of claim 5 wherein said bleach consists of 5¼% sodium hypochlorite present in an amount which is about 18% by weight of the composition.

7. The cleansing composition of claim 1 including about 0.3 up to 5 weight percent bleach stable detergent selected from the group consisting of sodium lauryl sulfate, potassium lauryl alkyl sulfate, sodium stearyl alkyl sulfate and potassium stearyl alkyl sulfate.

8. The cleansing composition of claim 7 wherein said detergent consists of sodium lauryl sulfate present in an amount which is less than 1% by weight of the composition.

9. The cleansing composition of claim 7 including about 0.1 up to 1 weight percent isobornylacetate.

* * * * *